US005344510A

United States Patent [19]

Allen et al.

[11] Patent Number: 5,344,510

[45] Date of Patent: Sep. 6, 1994

[54] METHOD FOR REMOVING SULFUR FROM SUPERALLOY ARTICLES TO IMPROVE THEIR OXIDATION RESISTANCE

[75] Inventors: William P. Allen, Portland; Donald R. Parille, South Windsor, both of Conn.

[73] Assignee: United Technologies Corporation, Hartford, Conn.

[21] Appl. No.: 48,407

[22] Filed: Apr. 14, 1993

[51] Int. Cl.[5] ..... C22F 1/10

[52] U.S. Cl. ..... 148/675; 75/626; 75/628; 148/426; 148/427; 148/428; 148/429

[58] Field of Search ..... 148/675, 426, 427, 428, 148/429; 75/626, 628

[56] References Cited

U.S. PATENT DOCUMENTS

| | | | |
|---|---|---|---|
| 1,710,846 | 4/1929 | Smith et al. | 75/628 |
| 3,853,540 | 12/1974 | Schlatter et al. | 75/628 |
| 3,891,425 | 6/1975 | McCarty | 75/628 |
| 4,209,348 | 6/1980 | Duhl et al. | 148/555 |
| 4,719,080 | 1/1988 | Duhl et al. | 420/443 |
| 4,895,201 | 1/1990 | DeCrescente et al. | 164/56.1 |

OTHER PUBLICATIONS

Corrosion & Particle Erosion at High Temperatures, by V. Srinivasan and K. Vedula; "Effect of Sulfur Removal on Scale Adhesion to PWA 1480", by B. K. Tubbs and J. L. Smialek (p. 459); 1989.

*Primary Examiner*—Richard W. Dean
*Assistant Examiner*—Robert R. Koehler
*Attorney, Agent, or Firm*—Charles E. Sohl

[57] ABSTRACT

Superalloy articles are made more oxidation resistant by a process which includes heating the article in an environment having a reduced pressure of inert gas and a low partial pressure of oxygen to a temperature at which the sulfur in the article diffuses out. The heat treatment is best carried out at a temperature within the range defined by the incipient melting temperature of the article and about 150° C. below the incipient melting temperature of the article. Alternatively, the heat treatment may be carried out at a temperature above the gamma prime solvus temperature of the article and below the incipient melting temperature of the article. At such temperatures, sulfur readily diffuses out of the article, and a more oxidation resistant component is produced.

9 Claims, 1 Drawing Sheet

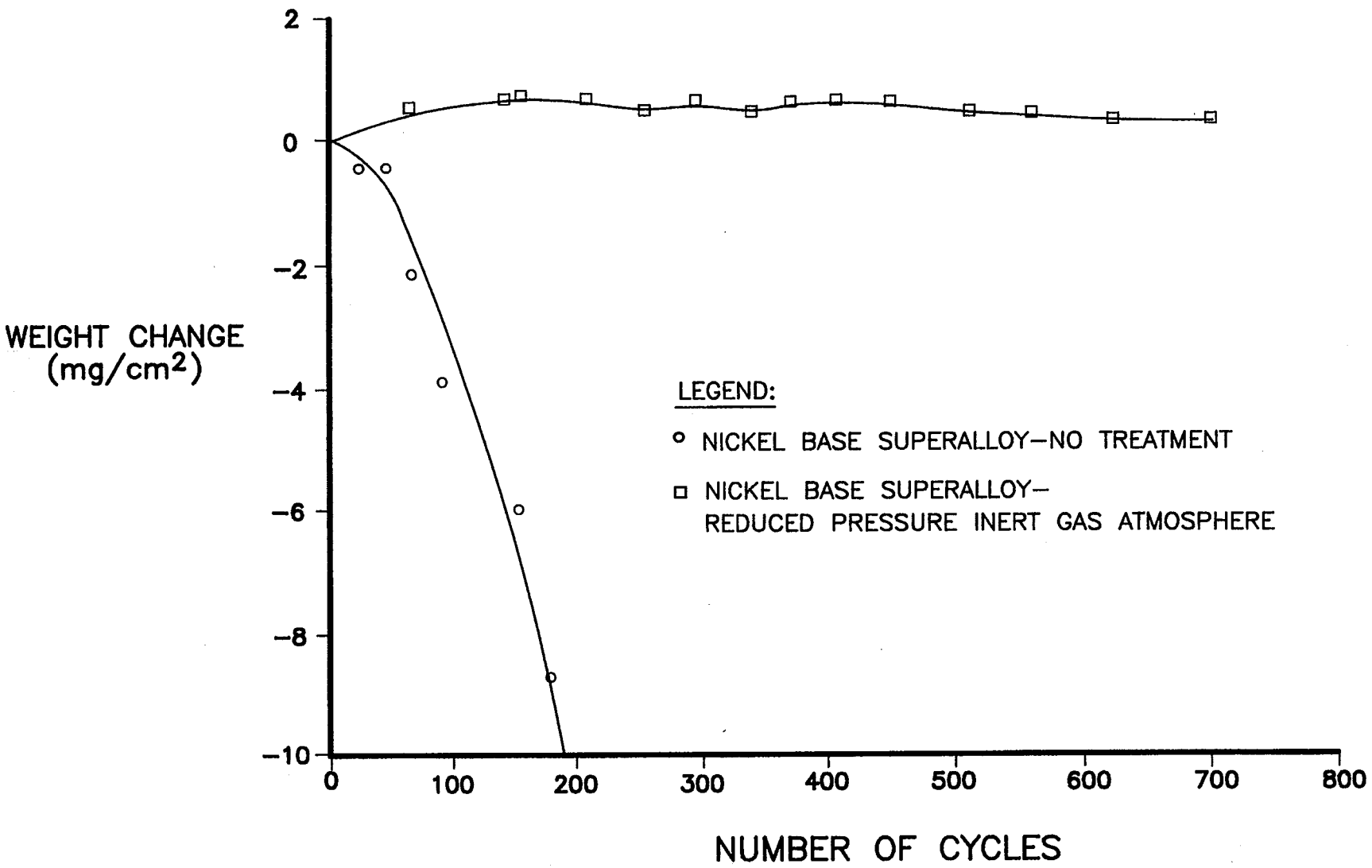
LEGEND:
○ NICKEL BASE SUPERALLOY–NO TREATMENT
□ NICKEL BASE SUPERALLOY–
REDUCED PRESSURE INERT GAS ATMOSPHERE
WEIGHT CHANGE
(mg/cm2)
2
0
−2
−4
−6
−8
−10
0
100
200
300
400
500
600
700
800
NUMBER OF CYCLES

METHOD FOR REMOVING SULFUR FROM SUPERALLOY ARTICLES TO IMPROVE THEIR OXIDATION RESISTANCE

TECHNICAL FIELD

This invention pertains to methods to improve the oxidation resistance of superalloy articles. In particular, the invention pertains to methods for removing sulfur from nickel base superalloy articles to improve their oxidation resistance.

BACKGROUND ART

Superalloys based on nickel are widely used in gas turbine engines, spacecraft engines, and other engines and machines which operate at high temperatures and stress levels. Castings made from such superalloys must have, as a minimum, two important properties: mechanical strength and resistance to oxidation at high temperatures. Unfortunately, the optimization of one property is often at the expense of the other. The highest strength superalloys do not have the best resistance to oxidation, and the most oxidation resistant superalloys do not have the best strength levels.

Efforts by researchers in the superalloy field have identified compositions which have the potential of providing a very good combination of strength and oxidation resistance. Cast components having such compositions include critical amounts of aluminum and/or titanium as well as oxygen active elements such as yttrium and hafnium. However, research to date has not been entirely successful in identifying cost effective means for reproduceably retaining the needed amounts of oxygen active elements in the casting.

The oxygen active element yttrium has long been used in coatings and more recently in structural alloys to improve oxidation behavior, but the method by which it improved oxidation resistance was not fully understood. Researchers have recently learned that yttrium produces its beneficial effect by immobilizing the sulfur which is inevitably present in the casting as an impurity. Free or mobile sulfur degrades an article's oxidation resistance by weakening the adherence of the protective oxide film which forms on the article's surface at high temperatures. Unfortunately, the known means for controlling the level of sulfur in superalloy castings such as those described in DeCrescente et al, U.S. Pat. No. 4,895,201, have been found to generally be expensive and difficult to implement in industry.

Accordingly, what is needed in the superalloy field are low sulfur superalloy articles which exhibit good mechanical strength, and relatively inexpensive and easily implemented methods for making them.

DISCLOSURE OF THE INVENTION

This invention is based on the discovery of a heat treatment process that can economically and effectively remove sulfur from superalloy articles, thereby significantly improving the oxidation resistance of the articles. According to this invention, superalloy articles are made more oxidation resistant by a process which includes ensuring that the article's surface is substantially free of any oxide and then heating the article in the presence of an inert gas, at a reduced pressure, to a temperature at which the sulfur in the article diffuses out. The heat treatment is best carried out at a temperature within the range defined by the incipient melting temperature of the article and about 150° C. below the incipient melting temperature of the article. Alternatively, the heat treatment may be carried out at a temperature above the gamma prime solvus temperature of the article and below the incipient melting temperature of the article. At such temperatures, sulfur readily diffuses out of the article, and a more oxidation resistant component is produced.

Other advantages, features and embodiments of the invention will be apparent from the following description of the best mode as read in light of the drawing.

BRIEF DESCRIPTION OF THE DRAWING

The FIGURE is a graph of weight change as a function of time, and shows the superior cyclic oxidation resistance of superalloy articles heat treated in accordance with the invention.

BEST MODE FOR CARRYING OUT THE INVENTION

The invention is directed to a method for making oxidation resistant superalloy articles. As used in this application, the term superalloy is used in the conventional sense, and describes the class of alloys specifically developed for use in high temperature environments and having a yield strength in excess of about 100 ksi at 1,000° F. Representative of such class of metal alloys include the nickel base superalloys containing aluminum and/or titanium which are strengthened by solution heat treatment and which usually contain chromium and other refractory elements such as tungsten and tantalum. Such alloys also usually contain greater than 5 parts per million, by weight ("ppm"), sulfur as an undesired impurity. Two such nickel base superalloys are known as PWA 1480 (see U.S. Pat. No. 4,209,348 to Duhl et al.) and PWA 1484 (see U.S. Pat. No. 4,719,080 to Duhl et al.). Other nickel base superalloys are known to those skilled in the art; see the book entitled "Superalloys II" Sims et al. ed., published by John Wiley & Sons, 1987.

The invention is effective in improving the oxidation resistance of nickel base superalloy articles by reducing the sulfur content of such articles to a level which is less than about 5 ppm. Because sulfur degrades the article's oxidation resistance by weakening the adherence of the protective oxide film which forms on the article surface at high temperatures, reducing the level of sulfur in the article improves the article's oxidation resistance by improving the adherence of the protective oxide film.

Since diffusion of sulfur through such an oxide film is very sluggish, effective desulfurization of nickel base superalloys is dependent upon either avoiding the presence of an oxide film, often $Al_2O_3$, on the article surface during the treatment or modifying the normally forming oxide film to render the film more permeable to sulfur diffusion.

Typically, the invention reduces the sulfur level to below about 3 ppm sulfur, and most preferably, to below about 1 ppm sulfur. Below about 5 ppm sulfur, nickel base superalloy articles have good resistance to oxidation; below about 3 ppm sulfur, nickel base superalloy articles have very good oxidation resistance; below about 1 ppm sulfur, nickel base superalloy articles have excellent resistance to oxidation. The above mentioned levels of sulfur content are as measured by either glow discharge mass spectroscopy (GDMS) utilizing a device such as the VG-9000, a product of Vacuum Generators, or combustion analysis using the LECO CS-44-LS a product of LECO, although other methods will be known by those skilled in the art.

In carrying out the invention, the article is first cleaned to remove any surface oxide which forms during casting. Mechanical or chemical removal of the surface oxide should accomplish equivalent results. If the article has been machined, or if the article has a substantially oxide-free surface, cleaning may not be required. After cleaning, the superalloy article is heated in the presence of an inert gas at a reduced pressure, to a temperature at which sulfur readily diffuses out of the article.

The intended operating conditions of the present invention are described below, but are generally from about 1,050° C. to about 1,370° C. in a system containing a reduced pressure of an inert gas, such as argon, with either a dynamic flow of the inert gas, or a static pressure of inert gas, and with a total system pressure within the range of approximately $10^{-6}$ torr to about 100 torr in either case. The system should also have a low partial pressure of oxygen, at a maximum of about 2 torr and preferrably below about 0.5 torr, so as to avoid the possibility of oxidation which would severely impede the diffusion of sulfur out of the article.

The rate at which sulfur diffuses from the article is a function of the temperature and time of the heat treatment, the relative sulfur activity in the workpiece and the atmosphere, furnace conditions, and the rate of sulfur diffusion from the workpiece.

Based upon diffusion theory, for a 20 mil nickel based superalloy sample processed at 1100° C. for about 25 hours, the sulfur content would be decreased from more than 5 ppm to about 0.5 ppm, with a diffusion coefficient for sulfur in the nickel-base superalloy of approximately $6.8\times10^{-9}$ $cm^2$/sec. For other alloys the time and/or temperature may need to be adjusted to achieve approximately the same rate of sulfur diffusion.

The minimum temperature at which the processes take place in a practical period of time is about 100° C. below the article's gamma prime solvus temperature or about 150° C. below the article's melting point. The maximum temperature for carrying out the invention is the article's incipient melting temperature. The gamma prime solvus temperature is the temperature at which the gamma prime phase goes into solution in the gamma phase matrix. Generally speaking, the gamma prime solvus temperature for nickel base superalloy castings is from about 1,150° C. to about 1,300° C. (from about 2,100° F. to about 2,370° F.). The incipient melting temperature for nickel base superalloy casting is generally from about 1,230° C. to about 1,370° C. (from about 2,250° F. to about 2,500° F.).

Typically, the heat treatment will be carried out for no more than 200 hours, with 50 hours being a typical time period for acceptable heat treatment, due primarily to economic considerations. All times are approximate and cumulative. At the completion of the heat treatment, the article contains no more than 5 ppm sulfur, preferably less than 3 ppm sulfur, and most preferably less than 1 ppm sulfur.

An advantage of the present invention is that the desulfurization process may be combined with solution heat treatment of the article. If the article is solution heat treated then after heating, in order to produce an article with a good mechanical properties, the article is cooled at a rate which is at least as fast as the cooling rate following the normal solution heat treatment for the article. For most superalloys, the cooling rate following normal solution heat treatment is at least about 55° C. per minute. If the desired cooling rate is not attainable, the normal solutioning treatment for the article should be performed after the heat treating method of this invention.

In summary, the article should be heat treated in the presence of a reduced pressure inert gas, such as argon, at a temperature within the range defined by the incipient melting temperature of the article and about 150° C. below the incipient melting temperature of the article. Alternatively, the heat treatment may be carried out at a temperature above the gamma prime solvus temperature of the article and below the incipient melting temperature of the article. The operating environment may either be static, i.e. no gas flow in or out of the system, or dynamic, i.e. gas flow both into and out of the system, with a total system pressure within the range of about $10^{-6}$ torr to about 100 torr, and a partial pressure of oxygen, not to exceed about 2 torr. Any oxide film which is present on the surface of the superalloy will be removed prior to the heat treating by mechanical or chemical cleaning. Heating the article in the operating environment of the present invention prevents subsequent oxide films from forming and therefore allows the sulfur to readily diffuse out of the article. Without such cleansing and heat treating an oxide film which is generally impervious to sulfur diffusion would form on the article.

The following example will illustrate additional features and aspects of this invention. The example is not to be construed as limitating the scope of the invention.

Single crystal nickel-base superalloy turbine blades having a hollow airfoil portion and a thicker root portion and also having compositions, on a weight percent basis, of 10Co-5.9W-1.9Mo-8.7Ta-5.6Al-3Re-5Cr-0.1Hf-balance Ni, a melting temperature of about 1340° C., gamma prime solvus temperature of about 1305° C., and containing about 8 to 10 ppm sulfur (as determined by GDMS) were processed according to this invention. This is a known, high strength superalloy composition, and is described in more detail in the above referenced patent '080 to Duhl et at. The airfoil portions were cleaned in a conventional laboratory fashion by grinding the surface with silicon-carbide paper. The turbine blades were then placed in a furnace which maintained a total system pressure of about 3 torr, a constant flow of argon gas, and a low partial pressure of oxygen, below about 0.6 torr. The turbine blades were heated to a temperature of about 1300° C. and held at about 1300° C. for approximately 50 hours. After the aforementioned heat treatment, the sulfur content in the airfoil portions was measured using a LECO CS-444-LS combustion analyzer and determined to be less than 1 ppm.

Samples having the same composition as above and subject to the same heat treatment were evaluated to measure their cyclic oxidation resistance, a common and important measurement for superalloy castings used in the gas turbine engine industry, and a qualitative measurement of sulfur in the casting. In these tests, the samples were cycled between 60 minutes at 1,200° C. and 30 minutes at room temperature; one cycle is comprised of the 60 and 30 minute combination. The results of the tests are shown in the FIGURE, where large weight losses are indicative of spallation of the protective oxide film and poor cyclic oxidation performance. Conversely, lower weight losses indicate better oxidation resistance. The FIGURE shows that the samples which were heat treated in accordance with this invention exhibit very little weight loss, as compared to samples which received no heat treatment. Airfoils heat treated in accordance with this invention, therefore, have excellent resistance to oxidation. The tests indicate the close correlation between reduced sulfur content in superalloy castings and excellent oxidation resistance.

Although this invention has been shown and described with respect to detailed embodiments thereof, it will be understood by those skilled in the art that various changes in form and detail thereof may be made without departing from the spirit and scope of the claimed invention. For example, while the invention is usually carried out on cast articles, it will also be useful in removing sulfur from wrought or forged articles, as well as articles made by powder metallurgy.

We claim:

1. A method for removing sulfur from a nickel base superalloy article comprising the step of heating the article in an environment having a reduced pressure of inert gas and a low partial pressure of oxygen, to a temperature at which sulfur diffuses out of the article.

2. The method of claim 1, wherein said article is cleaned prior to heat treatment in order to remove any surface oxide which has formed on said article.

3. The method of claim 1, wherein said environment has a total system pressure within the range of about $10^{-6}$ torr to about 100 torr.

4. The method of claim 1, wherein said partial pressure of oxygen is no greater than about 2 torr.

5. The method of claim 1, wherein the article is heated to a temperature within the range defined by the melting temperature of the article and approximately 150° C. below the melting temperature of the article.

6. The method of claim 1, wherein the sulfur in the article is reduced to below 5 parts per million, by weight.

7. The method of claim 1, wherein the sulfur in the article is reduced to below 3 parts per million, by weight.

8. The method of claim 1, wherein the sulfur in the article is reduced to below 1 parts per million, by weight.

9. A method for removing sulfur from a nickel base superalloy turbine blade, the blade having a root portion adjacent to an airfoil portion which is thinner than the root portion, comprising the step of heating the airfoil portion in an environment having a reduced pressure of inert gas, a low partial pressure of oxygen, and a total system pressure of about $10^{-6}$ torr to about 100 torr, wherein the airfoil portion is heated to a temperature at which sulfur diffuses out of the airfoil portion; whereby the sulfur in the airfoil portion is reduced to below about 5 parts per million, by weight.

* * * * *